US012122624B2

(12) United States Patent
Fukamachi et al.

(10) Patent No.: US 12,122,624 B2
(45) Date of Patent: Oct. 22, 2024

(54) POST-PROCESSING APPARATUS

(71) Applicant: FUJIFILM BUSINESS INNOVATION CORP., Tokyo (JP)

(72) Inventors: Takayuki Fukamachi, Kanagawa (JP); Eri Fukui, Kanagawa (JP); Koji Kawano, Kanagawa (JP); Yuki Mizuno, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 141 days.

(21) Appl. No.: 17/939,704

(22) Filed: Sep. 7, 2022

(65) Prior Publication Data

US 2023/0234798 A1 Jul. 27, 2023

(30) Foreign Application Priority Data

Jan. 24, 2022 (JP) ..... 2022-008822

(51) Int. Cl.
*B65H 29/50* (2006.01)

(52) U.S. Cl.
CPC ..... *B65H 29/50* (2013.01); *B65H 2511/13* (2013.01); *B65H 2511/15* (2013.01)

(58) Field of Classification Search
CPC ..... B65H 29/38; B65H 29/50; B65H 33/00; B65H 43/00; B65H 45/18; B65H 31/00; B65H 31/20; B65H 2511/13; B65H 2511/15
USPC ..... 270/37, 58.07, 58.08, 58.09
See application file for complete search history.

(56) References Cited

U.S. PATENT DOCUMENTS 6,145,825 A * 11/2000 Kunihiro ..... B42C 1/12 271/181
7,520,505 B2 * 4/2009 Thomas ..... B65H 29/14 271/220
7,862,026 B2 * 1/2011 Terao ..... B65H 29/52 270/58.11
11,091,344 B2 * 8/2021 Ueno ..... B42C 1/12
2008/0315494 A1 * 12/2008 Terao ..... B65H 31/02 270/58.27

FOREIGN PATENT DOCUMENTS

JP 2020-083624 A 6/2020

* cited by examiner

*Primary Examiner* — Leslie A Nicholson, III
(74) *Attorney, Agent, or Firm* — Oliff PLC

(57) ABSTRACT

A post-processing apparatus includes a guiding unit that faces a placement surface onto which sheets are transported and stacked as a stack of sheets and that is capable of changing a gap in a thickness direction of the stack of sheets, the guiding unit being configured to guide the sheets which are transported, and a controller that controls a size of the gap and a change pattern of the gap.

10 Claims, 10 Drawing Sheets

FIG. 10

| NUMBER OF SHEETS (PAGE) | BASIS WEIGHT OF SHEET (GSM) | GAP H (mm) |
|---|---|---|
| 1 | 70 | 1 |
| | 90 | 1.1 |
| | 110 | 1.15 |
| 2 | 70 | 1.5 |
| | 90 | 1.6 |
| | 110 | 1.65 |
| ·<br>· | ·<br>· | ·<br>· |
| 10 | 70 | 5.5 |
| | 90 | 6.5 |
| | 110 | 7 |
| ·<br>· | ·<br>· | ·<br>· |

POST-PROCESSING APPARATUS

CROSS-REFERENCE TO RELATED APPLICATIONS

This application is based on and claims priority under 35 USC 119 from Japanese Patent Application No. 2022-008822 filed Jan. 24, 2022.

BACKGROUND

(i) Technical Field

The present disclosure relates to a post-processing apparatus.

(ii) Related Art

There is known a medium transport device including a feeding unit, a stacking unit, and an alignment unit (Japanese Unexamined Patent Application Publication No. 2020-83624). The feeding unit transports a medium. The stacking unit receives a medium transported by the feeding unit and allows the medium to be stacked between a support surface, which supports media such that each medium being in an inclined position at which a downstream side thereof in a transport direction is oriented downward, and a counter surface that faces the support surface. The alignment unit aligns downstream ends of media stacked in the stacking unit. The stacking unit is configured such that the distance between the support surface and the counter surface can be changed, and a controller that controls the distance adjusts the distance in accordance with a condition.

SUMMARY

Aspects of non-limiting embodiments of the present disclosure relate to suppressing deterioration in the accuracy with which stacked sheets are folded compared with the case where a gap in which sheets are stacked is fixed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a post-processing apparatus including a guiding unit that faces a placement surface onto which sheets are transported and stacked as a stack of sheets and that is capable of changing a gap in a thickness direction of the stack of sheets, the guiding unit being configured to guide the sheets which are transported, and a controller that controls a size of the gap and a change pattern of the gap.

BRIEF DESCRIPTION OF THE DRAWINGS

An exemplary embodiment of the present disclosure will be described in detail based on the following figures, wherein:

FIG. 10 is a table illustrating examples of a gap that is set with respect to the number of sheets and the basis weight of each sheet.

DETAILED DESCRIPTION

Figure 1:
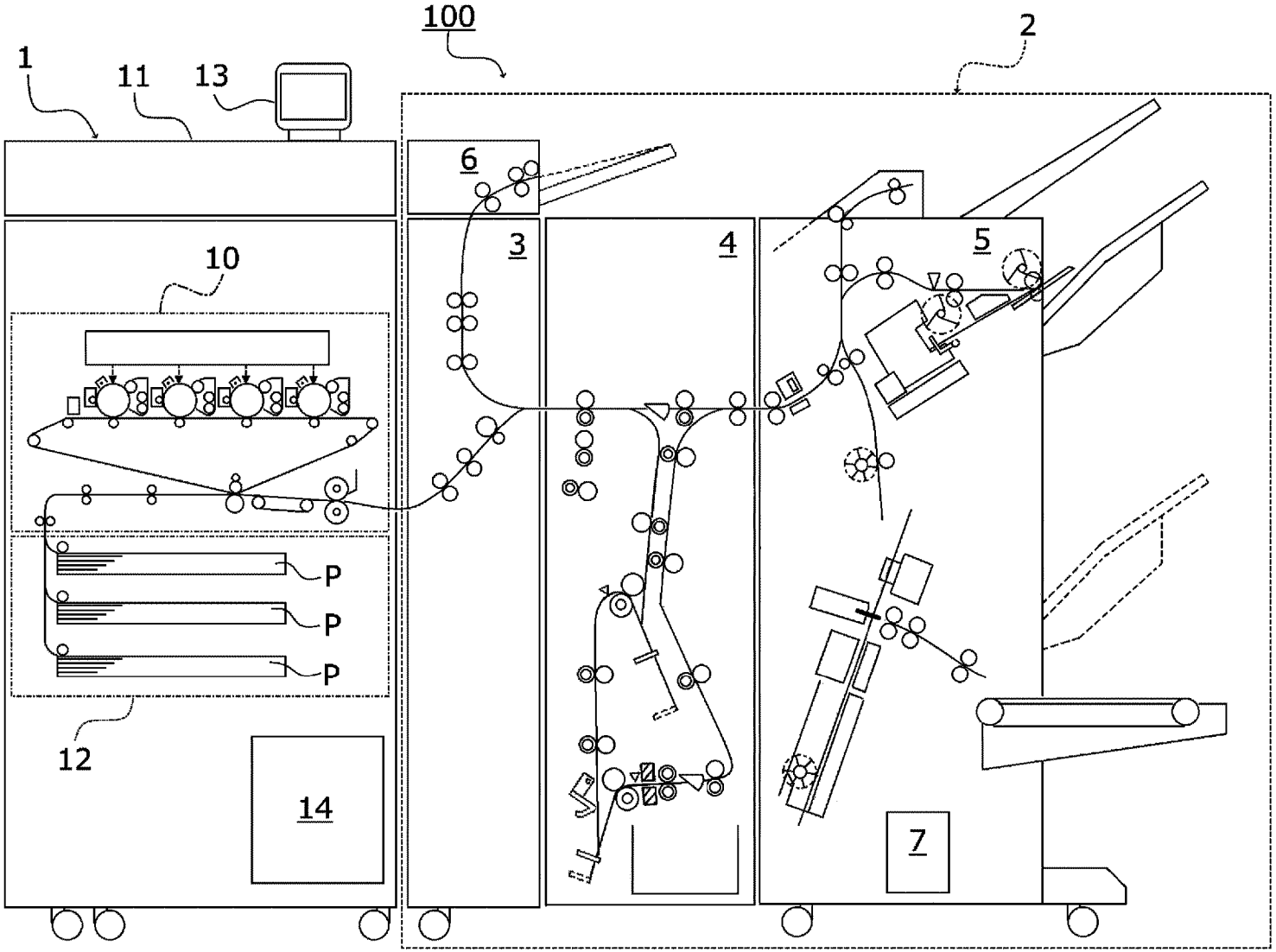
FIG. 1 is a schematic diagram illustrating a configuration of an image forming system to which a post-processing apparatus according to the present exemplary embodiment is applied.

Although an exemplary embodiment of the present disclosure will be described in detail below using a specific example and with reference to the drawings, the present disclosure is not limited to the exemplary embodiment and the specific example.

In addition, in the drawings that will be referred to in the following description, objects are schematically illustrated, and it should be noted that dimensional ratios and so forth of the objects that are illustrated in the drawings are different from those of actual objects. Furthermore, for ease of understanding, illustration of components that are not necessary for the following description is suitably omitted in the drawings.

(1) Overall Configuration and Operation of Image Forming System

FIG. 1 is a schematic diagram illustrating a configuration of an image forming system 100 to which a post-processing apparatus according to the present exemplary embodiment is applied. The image forming system 100 illustrated in FIG. 1 includes an image forming apparatus 1, such as a printer or a copying machine, that employs an electrophotographic system and forms an image and a post-processing apparatus 2 that performs post-processing on at least one of sheets P on which toner images have been formed by the image forming apparatus 1.

The image forming apparatus 1 includes an image forming device 10 that forms an image on the basis of image data, an image reading device 11 that generates read image data by reading an image from a document, a sheet-feeding device 12 that feeds the sheets P to the image forming section 10, a user interface 13 that receives an operation input from a user of the image forming system 100 and performs display of various information items to the user, and a controller 14 that performs overall operational control of the image forming system 100.

The image forming device 10 includes photoconductors. A charging unit, an exposure unit, a developing unit, a transfer unit, and a cleaning unit are arranged around each of the photoconductors. Each of the charging units uniformly charges the corresponding photoconductor. Each of the exposure units causes a light beam to scan on the basis of image data. Each of the developing units develops, with a toner, an electrostatic latent image that is formed as a result of the corresponding exposure unit performing scanning and irradiation. Each of the transfer units transfers a toner image developed on the corresponding photoconductor to one of the sheets P. Each of the cleaning units cleans the surface of the corresponding photoconductor after transfer of a toner image. The image forming device 10 further includes a fixing unit disposed on a transport path along which the sheets P are transported, and the fixing unit fixes a toner image that has been transferred to one of the sheets P onto the sheet P.

The post-processing apparatus 2 includes a transport device 3, a folding device 4, and a finisher device 5. The transport device 3 receives the sheets P on which images have been formed from the image forming apparatus 1 and transports the sheet P. The folding device 4 performs a folding operation on each of the sheets P that are transported thereto from the transport device 3. The finisher device 5 performs a final operation on each of the sheets P that have passed through the folding device 4.

The post-processing apparatus 2 further includes an interposer 6 and a sheet-processing controller 7. The interposer 6 supplies a laminated sheet that is used for making, for example, a cover of a booklet. The sheet-processing controller 7 controls each functional unit of the post-processing apparatus 2. Note that, although FIG. 1 illustrates the configuration in which the sheet-processing controller 7 is disposed in the post-processing apparatus 2, the sheet-processing controller 7 may be disposed in the image forming apparatus 1. Alternatively, the controller 14 that is included in the image forming apparatus 1 and that performs overall operational control of the image forming system 100 may have the control function of the sheet-processing controller 7.

(2) Post-Processing Apparatus

Figure 2:
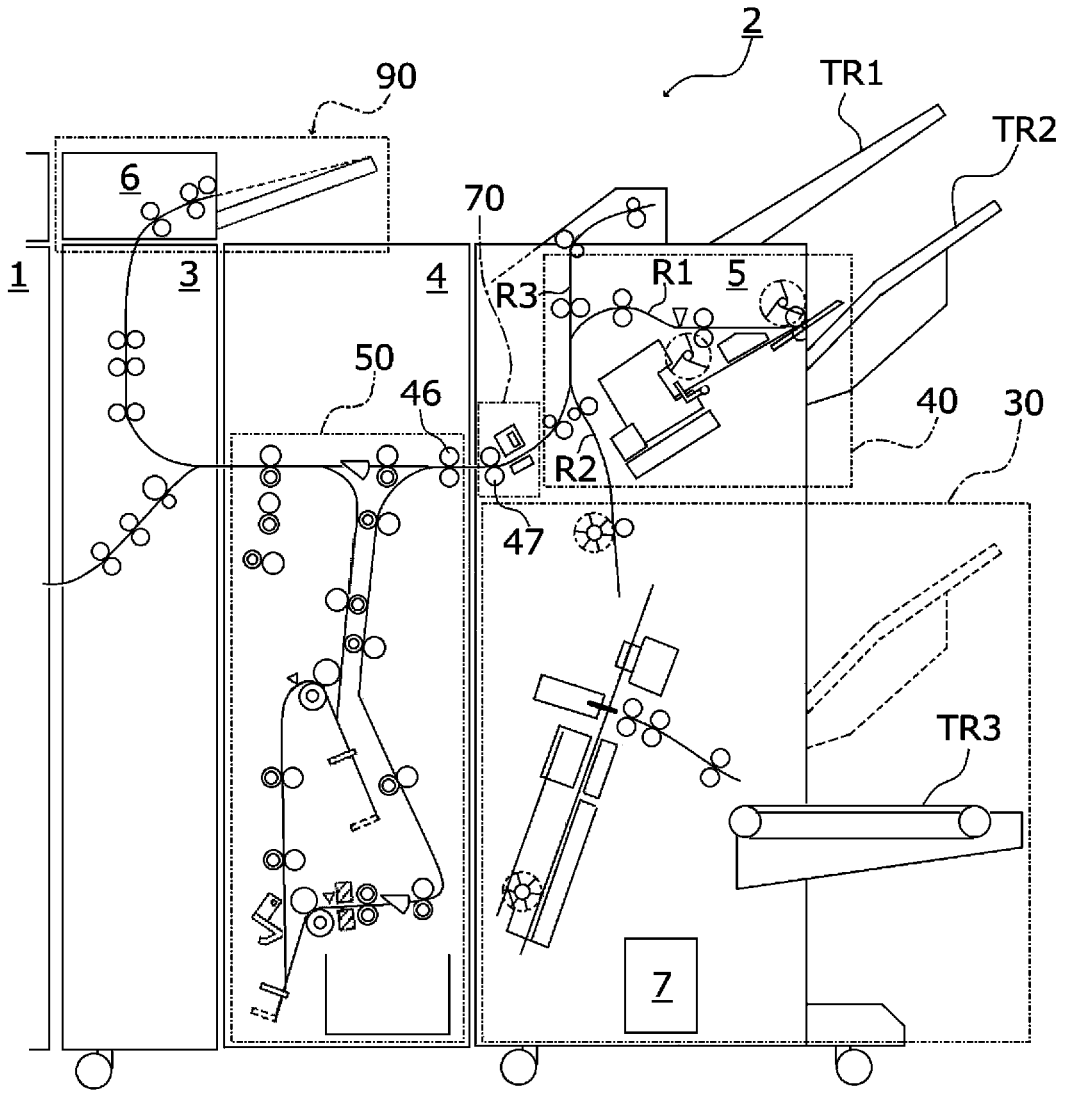
FIG. 2 is a diagram illustrating functions of the post-processing apparatus according to the present exemplary embodiment.
Figure 3:
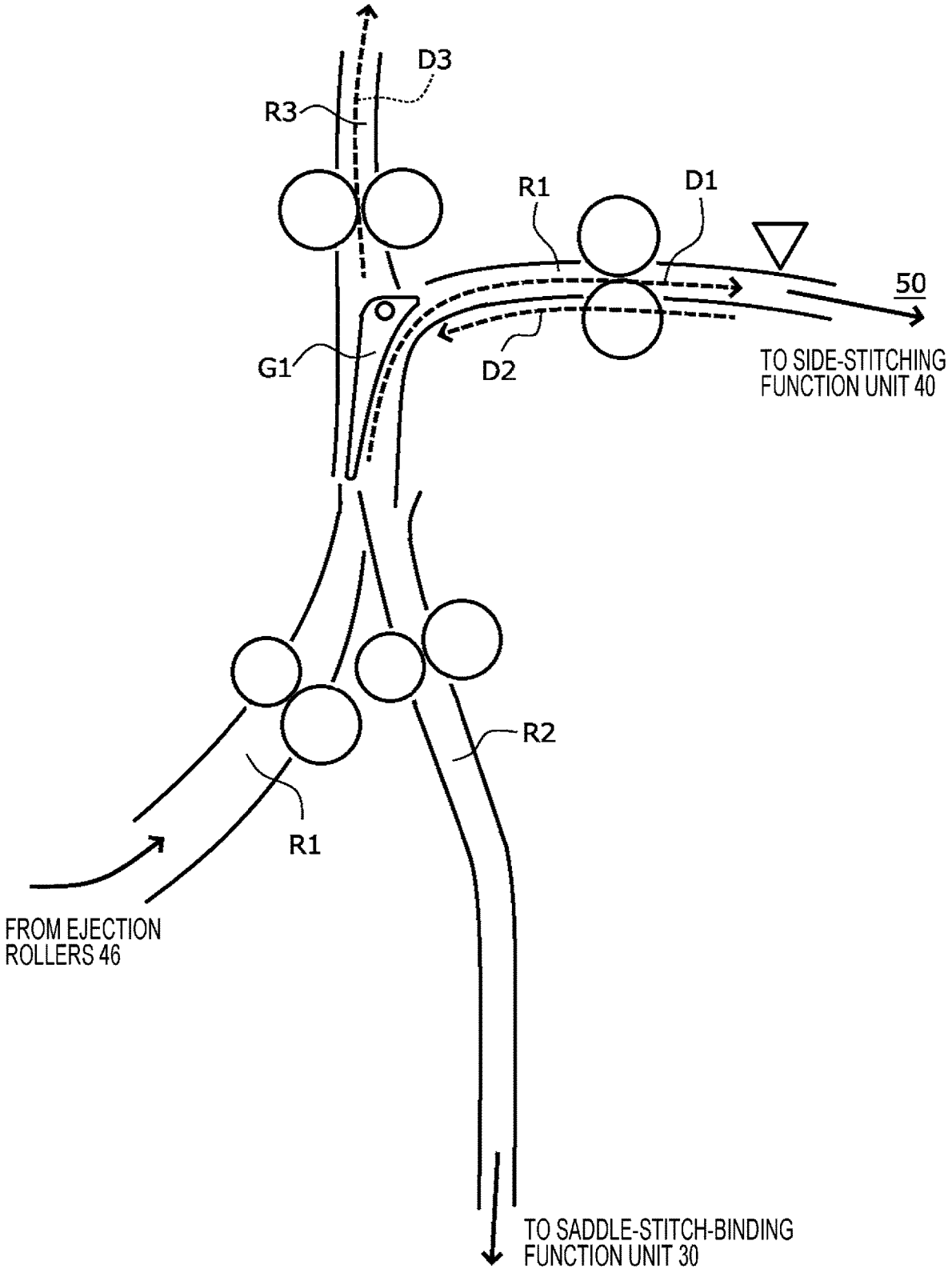
FIG. 3 is a diagram illustrating transportation of a sheet in a finisher unit.

FIG. 2 is a diagram illustrating functions of the post-processing apparatus 2, and FIG. 3 is a diagram illustrating transportation of one of the sheets P in the finisher device 5.

In the post-processing apparatus 2, the finisher device 5 includes a punching function unit 70, a side-stitching function unit 40, and a saddle-stitch-binding function unit 30. The punching function unit 70 performs punching on the sheets P (punches, for example, two holes or four holes in the sheets P). The side-stitching function unit 40 allows a necessary number of the sheets P to be stacked on top of one another so as to form a stack of sheets PB and performs a binding operation (side stitching) on an end portion of the stack of sheets PB. The saddle-stitch-binding function unit 30 allows a necessary number of the sheets P to be stacked on top of one another so as to form the stack of sheets PB and performs a binding operation (saddle stitching) on a center portion of the stack of sheets PB so as to bind a booklet.

The finisher device 5 includes a first sheet-transport path R1, a second sheet-transport path R2, and a third sheet-transport path R3, and these sheet-transport paths R1 to R3 are arranged downstream from receiving rollers 47 that receive the sheets P that are sent into the finisher device 5 by ejection rollers 46 of the folding device 4. The first sheet-transport path R1, the second sheet-transport path R2, and the third sheet-transport path R3 are configured to be selected by a switching gate G1 (see FIG. 3).

The first sheet-transport path R1 transports the sheets P that are sent thereto through the receiving rollers 47 to the side-stitching function unit 40 (in a sheet-transport direction D1 in FIG. 3).

The second sheet-transport path R2 branches off from the first sheet-transport path R1 and is connected to the saddle-stitch-binding function unit 30. A booklet produced by the saddle-stitch-binding function unit 30 is ejected to a booklet tray TR3 (see FIG. 2). The second sheet-transport path R2 temporarily holds at least one of the sheets P that is reversed in the first sheet-transport path R1 and transported (in a sheet-transport direction D2 in FIG. 3). The first sheet-transport path R1 and the second sheet-transport path R2 form a buffer unit that allows some of the sheets P to be stacked on top of one another and transported.

The third sheet-transport path R3 branches off from the first sheet-transport path R1 and is connected to a top tray TR1 (see FIG. 2), and the sheets P that are not subjected to the post-processing are ejected from the third sheet-transport path R3 (in a sheet-transport direction D3 in FIG. 3).

The folding device 4 includes a folding function unit 50 that performs folding such as a letter fold (a C fold) or an accordion fold (a Z fold) on at least one of the sheets P.

The interposer 6 or the transport device 3 includes a laminated-sheet supply function unit 90 that supplies a laminated sheet such as a thick sheet or a sheet with an opening that is used for a cover of a booklet, which is formed by binding the stack of sheets PB.

(2.1) Configuration of Saddle-Stitch-Binding Function Unit

Figure 4:
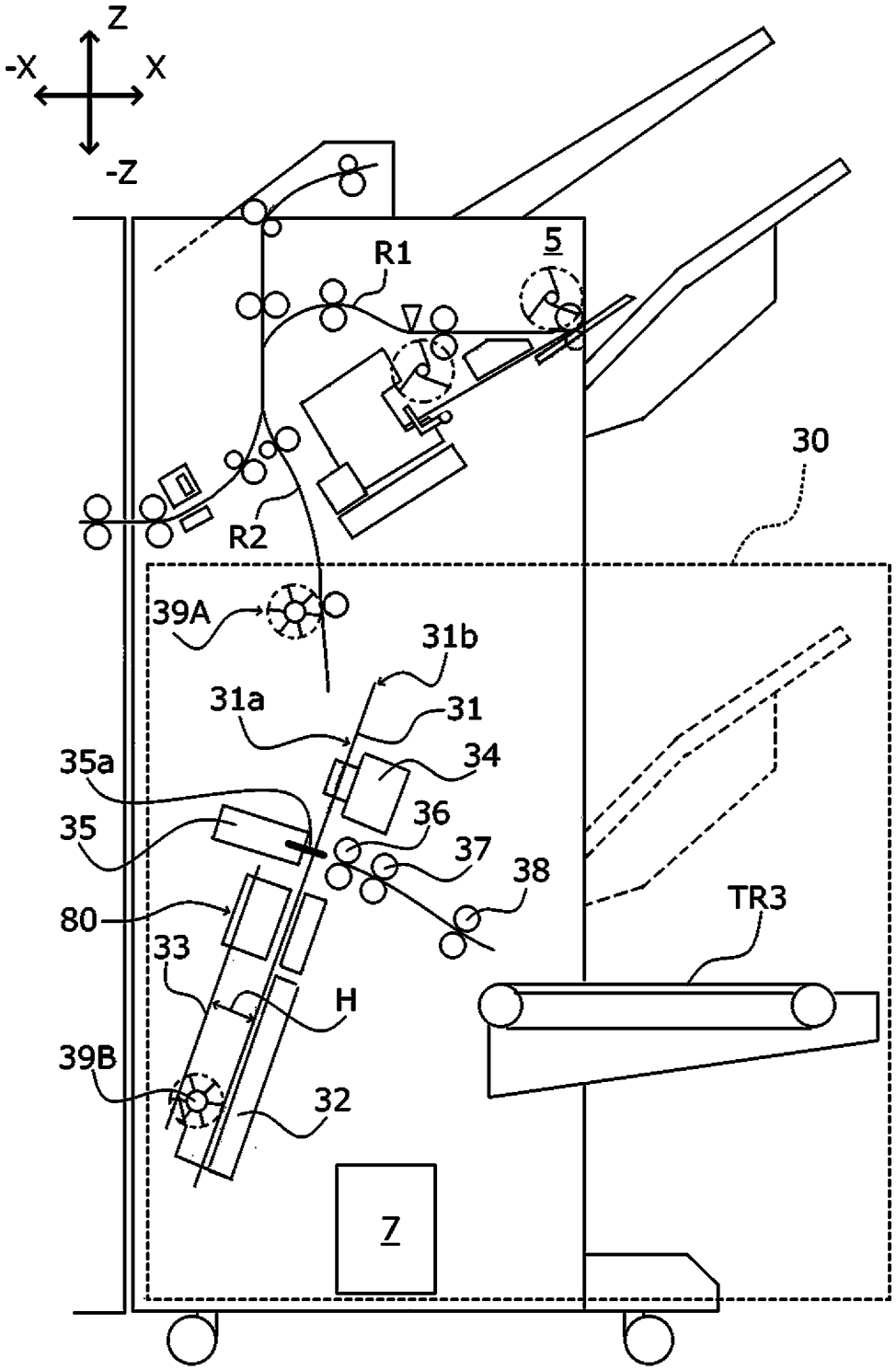
FIG. 4 is a diagram illustrating a configuration of a saddle-stitch-binding function unit.

FIG. 4 is a diagram illustrating the configuration of the saddle-stitch-binding function unit 30.

As illustrated in FIG. 4, the saddle-stitch-binding function unit 30 that binds the stack of sheets PB into a booklet includes a compilation tray 31, a transport roller 39A, an end guide 32, and a guide 33. The compilation tray 31 allows a predetermined number of the sheets P on each of which an image has been formed to be stacked thereon. The transport roller 39A transports the sheets P one at a time into the compilation tray 31. The end guide 32 moves along the compilation tray 31 while the stack of sheets PB is placed on a positioning stopper, which is provided on the compilation tray 31 in a protruding manner, and determines a saddle-stitching position and a folding position of the stack of sheets PB. The guide 33 is an example of a guiding unit that is disposed at a position upstream from the end guide 32 in a direction in which the sheets P are transported so as to face the compilation tray 31 and that guides the sheets P that are transported into the compilation tray 31.

The saddle-stitch-binding function unit 30 further includes a sheet-aligning paddle 39B and a sheet-width-aligning member 80. The sheet-aligning paddle 39B aligns the sheets P stacked on the compilation tray 31 toward the end guide 32. The sheet-width-aligning member 80 aligns the sheets P, which are stacked on the compilation tray 31, in a width direction of the sheets P.

In addition, the saddle-stitch-binding function unit 30 includes a stapler 34, a folding mechanism 35, and folding rollers 36. The stapler 34 performs a binding operation by driving a binding needle through the stack of sheets PB on the compilation tray 31. The folding mechanism 35 includes a folding knife 35*a* that moves with respect to the stack of sheets PB that has undergone the binding operation in such a manner as to project in a direction from the backside of the compilation tray 31 toward a placement surface 31*a* of the compilation tray 31. The folding rollers 36 are a pair of rollers and nip the stack of sheets PB once the folding knife 35*a* starts folding the stack of sheets PB.

The saddle-stitch-binding function unit 30 further includes transport rollers 37, the booklet tray TR3, and transport rollers 38. The transport rollers 37 are disposed downstream from the folding rollers 36 and transport the stack of sheets PB that has been folded into a booklet by the folding mechanism 35 and the folding rollers 36. The stack of sheets PB in the form of a booklet is to be placed on the booklet tray TR3, and the transport rollers 38 transport the stack of sheets PB to the booklet tray TR3.

(2.2) Compiling Operation of Saddle-Stitch-Binding Function Unit

Figure 5A:
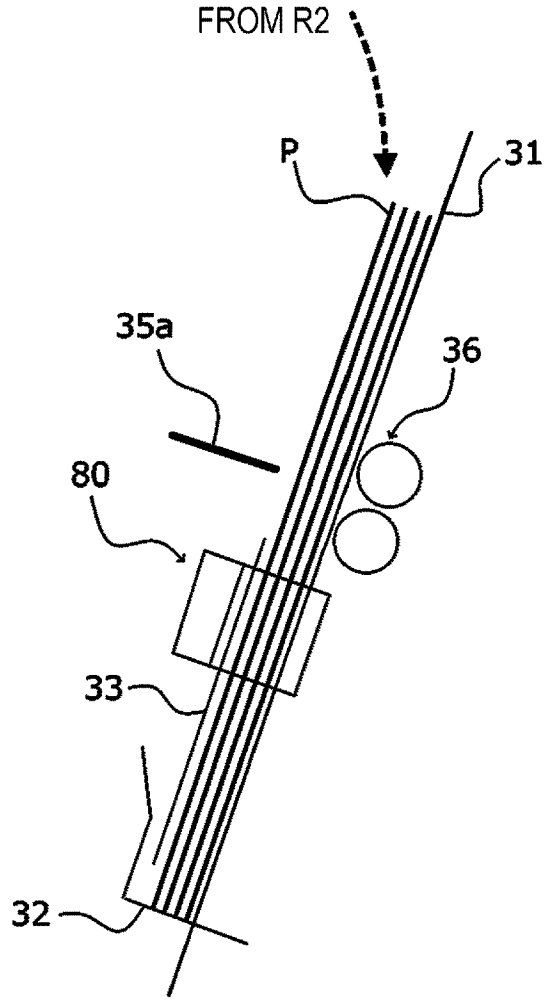
FIGS. 5A to 5C are schematic diagrams illustrating the flow of a middle-folding operation in the saddle-stitch-binding function unit.
Figure 5B:
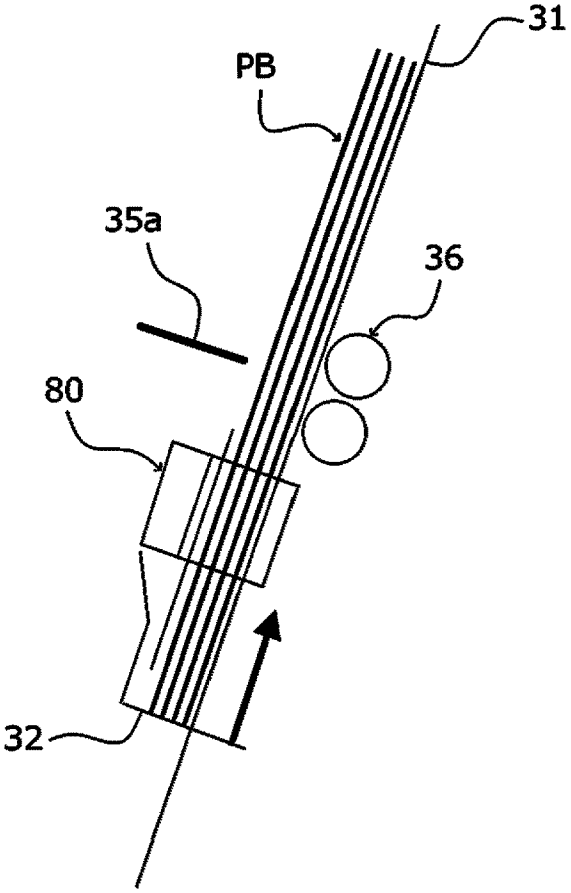
Figure 5C:
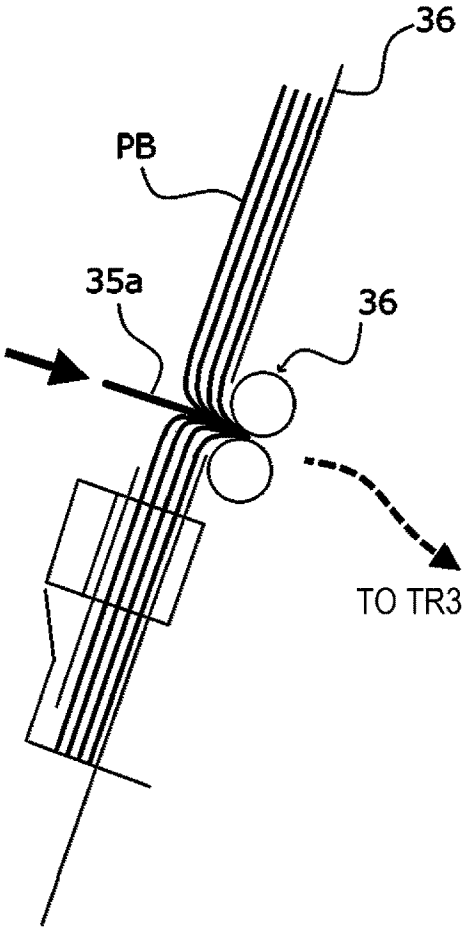

FIGS. 5A to 5C are schematic diagrams illustrating the flow of a middle-folding operation in the saddle-stitch-binding function unit 30.

The flow of the middle-folding operation in the saddle-stitch-binding function unit 30 will be described below with reference to the drawings.

In the case of producing a saddle-stitched booklet, as illustrated in FIG. 5A, the sheets P are pushed out of the second sheet-transport path R2 by the transport roller 39A (see FIG. 4) and stacked onto the compilation tray 31. The number of the sheets P that are stacked onto the compilation tray 31 is set by the controller 14 of the image forming apparatus 1 and is, for example, 5, 10, 15, or 30.

In this case, for example, the end guide 32 is moved and stopped such that center portions of the sheets P are positioned so as to be stapled by the stapler 34. The sheet-aligning paddle 39B (see FIG. 4) assists sheet alignment by rotating toward the end guide 32 and pressing the stacked sheets P against the end guide 32.

After a predetermined number of the sheets P have been stacked on the compilation tray 31, a predetermined portion (e.g., the center portion) of the stack of sheets PB is saddle stitched by the stapler 34.

Then, as illustrated in FIG. 5B, the end guide 35 is moved upward along the compilation tray 31 (indicated by an arrow in FIG. 5B), and the saddle-stitched stack of sheets PB is transported in such a manner that a portion (e.g., the center portion) of the stack of sheets PB that is to be folded is located at the position of the tip of the folding knife 35*a*. Note that, during the process of stacking the sheets P onto the compilation tray 31, the process of saddle stitching the stack of sheets PB by the stapler 34, and the process of transporting the saddle-stitched stack of sheets PB, the tip of the folding knife 35*a* is located at a retracted position below the compilation tray 31 so as not to project from a surface of the compilation tray 31.

After the stack of sheets PB has been transported in such a manner that the portion of the stack of sheets PB to be folded has been located at the position of the tip of the folding knife 35*a*, the folding knife 35*a* is pushed from below the compilation tray 31 in a direction perpendicular to the placement surface 31*a* of the compilation tray 31, and the tip comes into contact with the stack of sheets PB.

The tip is further pushed in an upward direction, and as illustrated in FIG. 5C, the stack of sheets PB is lifted and be nipped between the folding rollers 36. In addition, the folding knife 35*a* is moved to a position where the folding knife 35*a* causes the stack of sheets PB to be sufficiently engaged with the folding rollers 36.

After the folding rollers 36 have put a crease in the stack of sheets PB in the manner described above, the stack of sheets PB is transported as a booklet to the transport rollers 38 while the folded portion serves as the leading end of the stack of sheets PB and ejected onto the booklet tray TR3 (see FIG. 4).

In the case of producing a booklet in the manner described above, the sheet-processing controller 7 controls the size of a gap H between the placement surface 31*a* of the compilation tray 31, on which the sheets P are to be placed as the stack of sheets PB, and the guide 33 in a thickness direction of the stack of sheets PB and a change pattern of the gap H so as to suppress deterioration in the accuracy with which the stack of sheets PB is folded.

(2.3) Flow of Operation of Saddle-Stitch-Binding Function Unit

Figure 6:
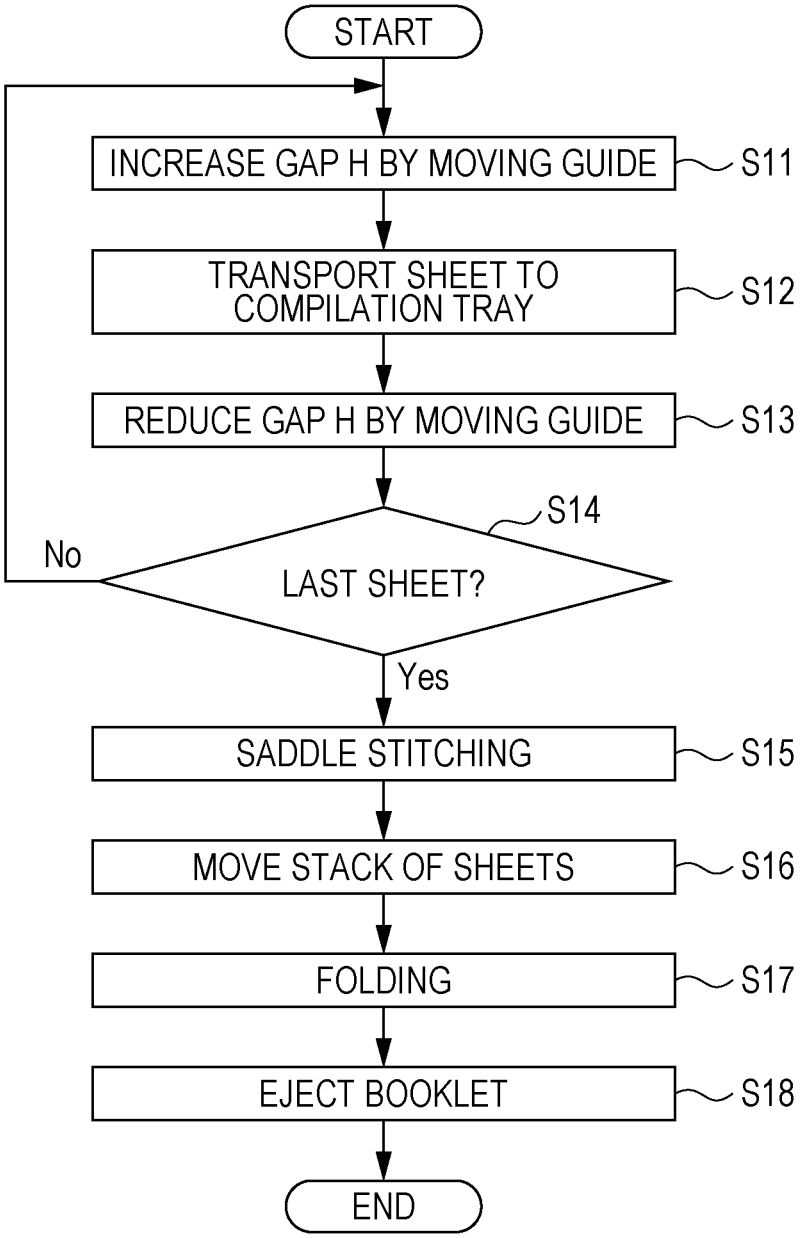
FIG. 6 is a flowchart illustrating the flow of an operation of the saddle-stitch-binding function unit.

FIG. 6 is a flowchart illustrating the flow of the operation of the saddle-stitch-binding function unit 30. FIG. 7A to FIG. 7D are schematic diagrams illustrating the flow of the middle-folding operation in the saddle-stitch-binding function unit 30. FIG. 10 is a table illustrating examples of a gap that is set with respect to the number of sheets and the basis weight of each sheet.

Figure 7A:
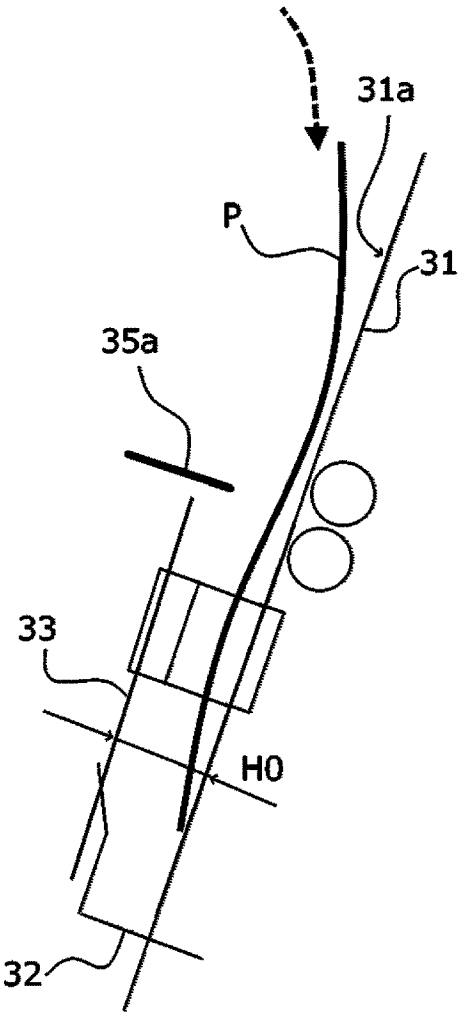
FIG. 7A to FIG. 7D are schematic diagrams illustrating the flow of the middle-folding operation in the saddle-stitch-binding function unit.

First, in a state where the guide 33 has been moved such that the gap H between the placement surface 31*a* of the compilation tray 31 and the guide 33 becomes maximum (S11), one of the sheets P on which an image has been formed by the image forming apparatus 1 is sent into the second sheet-transport path R2 through the receiving rollers 47 and transported along the second sheet-transport path R2 into the compilation tray 31 by the transport roller 39A (S12: see H0 in FIG. 7A).

Figure 7B:
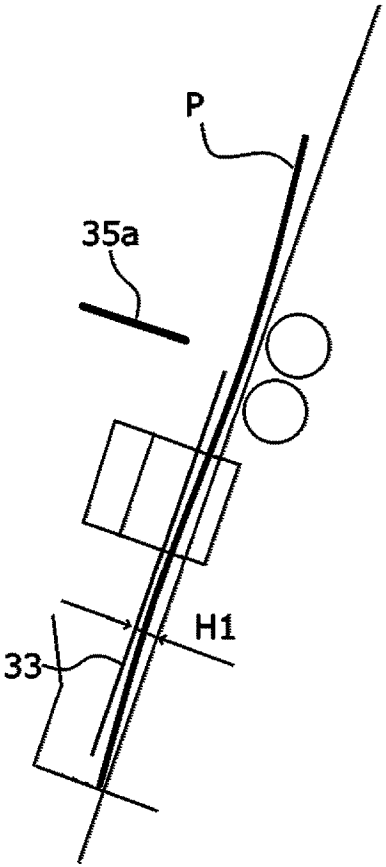

Then, the guide 33 is moved so as to reduce the gap H between the placement surface 31*a* of the compilation tray 31 and the guide 33 (S13: see FIG. 7B). The gap H (H1 in FIG. 7B) is determined by referencing to a table including values of the gap H that are predetermined in accordance with the number of the sheets P that are placed onto the placement surface 31*a* of the compilation tray 31 and the basis weight of each sheet P. FIG. 10 illustrates an example of the table.

More specifically, the gap H is set in such a manner as to increase as the number of the sheets P that are to be stacked onto the placement surface 31*a* of the compilation tray 31 becomes larger. For example, when the number of the sheets P to be stacked is 1, the gap H is set to 1.0 mm. When the number of the sheets P to be stacked is 2, the gap H is set to 1.5 mm. When the number of the sheets P to be stacked is 10, the gap H is set to 5.5 mm. In this manner, the gap H is set in such a manner as to gradually increase in accordance with the number of the sheets P to be stacked onto the placement surface 31*a*. In addition, the gap H is set in such a manner as to increase as the basis weight of each sheet P becomes greater. For example, when the basis weight of each sheet P is 90 GSM, the gap H is set to be larger than that when the basis weight of each sheet P is 70 GSM by 0.1 mm. When the basis weight of each sheet P is 110 GSM, the gap H is set to be larger than that when the basis weight of each sheet P is 70 GSM by 0.15 mm.

Subsequently, it is determined whether the sheet P transported by the transport roller 39A is the last sheet (S14).

Note that whether the transported sheet P is the last sheet is determined on the basis of the number of the sheets P set by the controller 14 of the image forming apparatus 1.

Figure 7C:
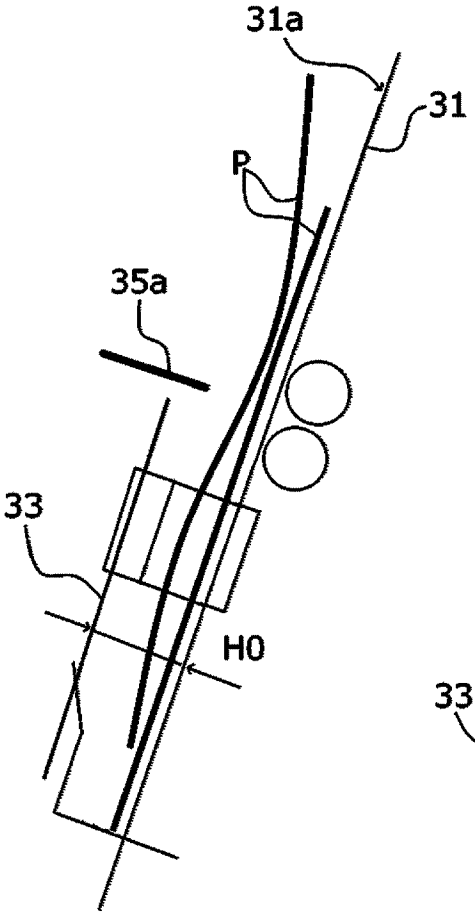
Figure 7D:
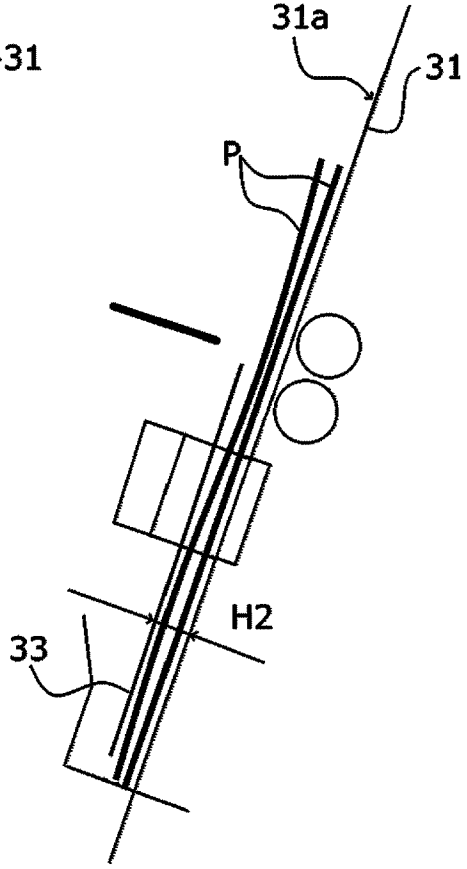

When it is determined in step S14 that the sheet P is not the last sheet (No in S14), the guide 33 is moved such that the gap H between the placement surface 31*a* of the compilation tray 31 and the guide 33 becomes maximum (S11), and the next sheet P is transported into the compilation tray 31 (S12: see FIG. 7C). Then, by referencing to the table, the guide 33 is moved so as to reduce the gap H between the placement surface 31*a* of the compilation tray 31 and the guide 33 (S13: see H2 in FIG. 7D).

The operation of increasing the gap H each time the compilation tray 31 receives one of the sheets P and the operation of reducing the gap H by referencing to the table are repeated until the last sheet is stacked on the compilation tray 31.

When it is determined that the sheet P transported to the compilation tray 31 is the last sheet (Yes in S14), a predetermined portion (e.g., the center portion) of the stack of sheets PB that has undergone sheet alignment is saddle stitched by the stapler 34 in the state where the gap H between the placement surface 31*a* of the compilation tray 31 and the guide 33 has been reduced (S15).

Then, the saddle-stitched stack of sheets PB is moved in such a manner that the folded portion (e.g., the center portion) of the stack of sheets PB is located at the position of the tip of the folding knife 35*a* (S16), and the tip of the folding knife 35*a* comes into contact with the stack of sheets PB from the backside of the stack of sheets PB, so that the stack of sheets PB is pushed and lifted so as to be nipped between the folding rollers 36 (S17). After the folding rollers 36 have put a crease in the stack of sheets PB in the manner described above, the stack of sheets PB is transported as a booklet to the transport rollers 38 while the folded portion serves as the leading end of the stack of sheets PB and ejected onto the booklet tray TR3 (S18).

[Modification]

Figure 8:
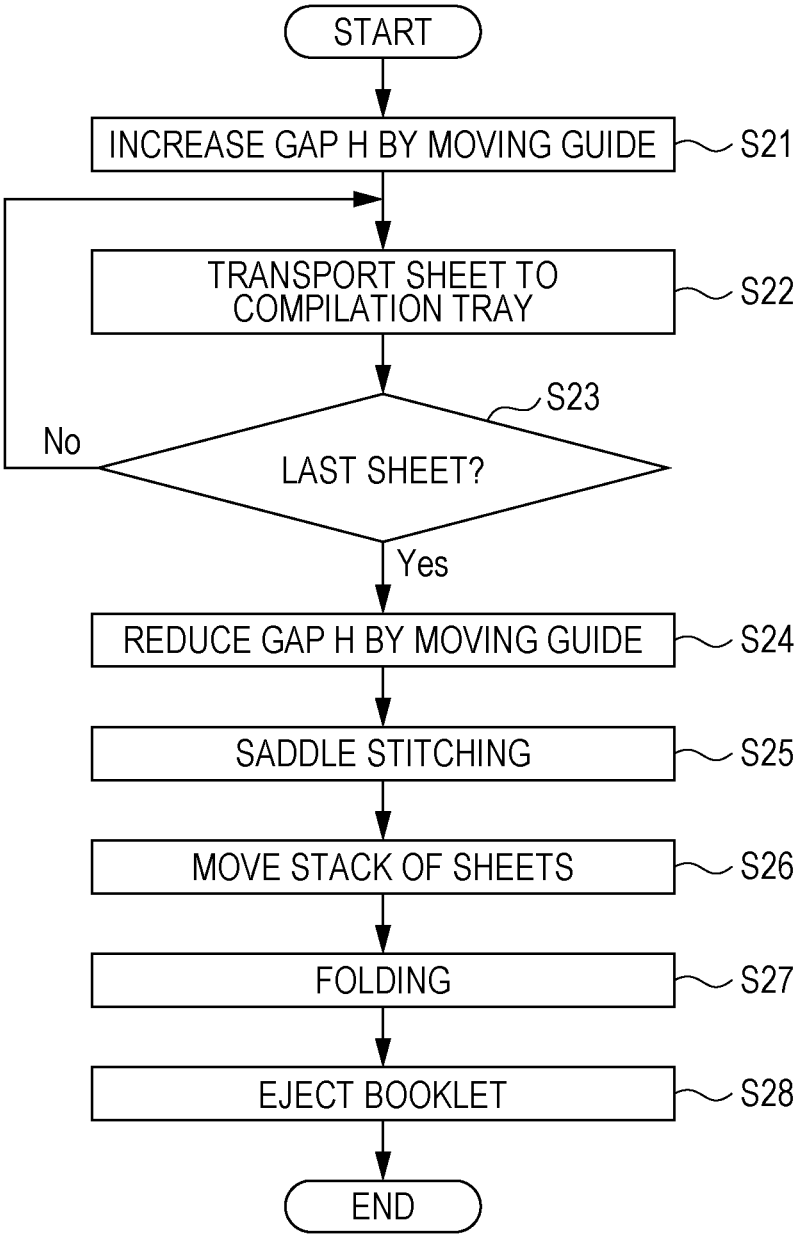
FIG. 8 is a flowchart illustrating the flow of an operation of a saddle-stitch-binding function unit according to a modification.

FIG. 8 is a flowchart illustrating the flow of an operation of the saddle-stitch-binding function unit 30 according to a modification, and FIGS. 9A to 9D are schematic diagrams illustrating the flow of the middle-folding operation in the saddle-stitch-binding function unit 30 according to the modification.

Figures 9A, 9B, 9C, 9D:
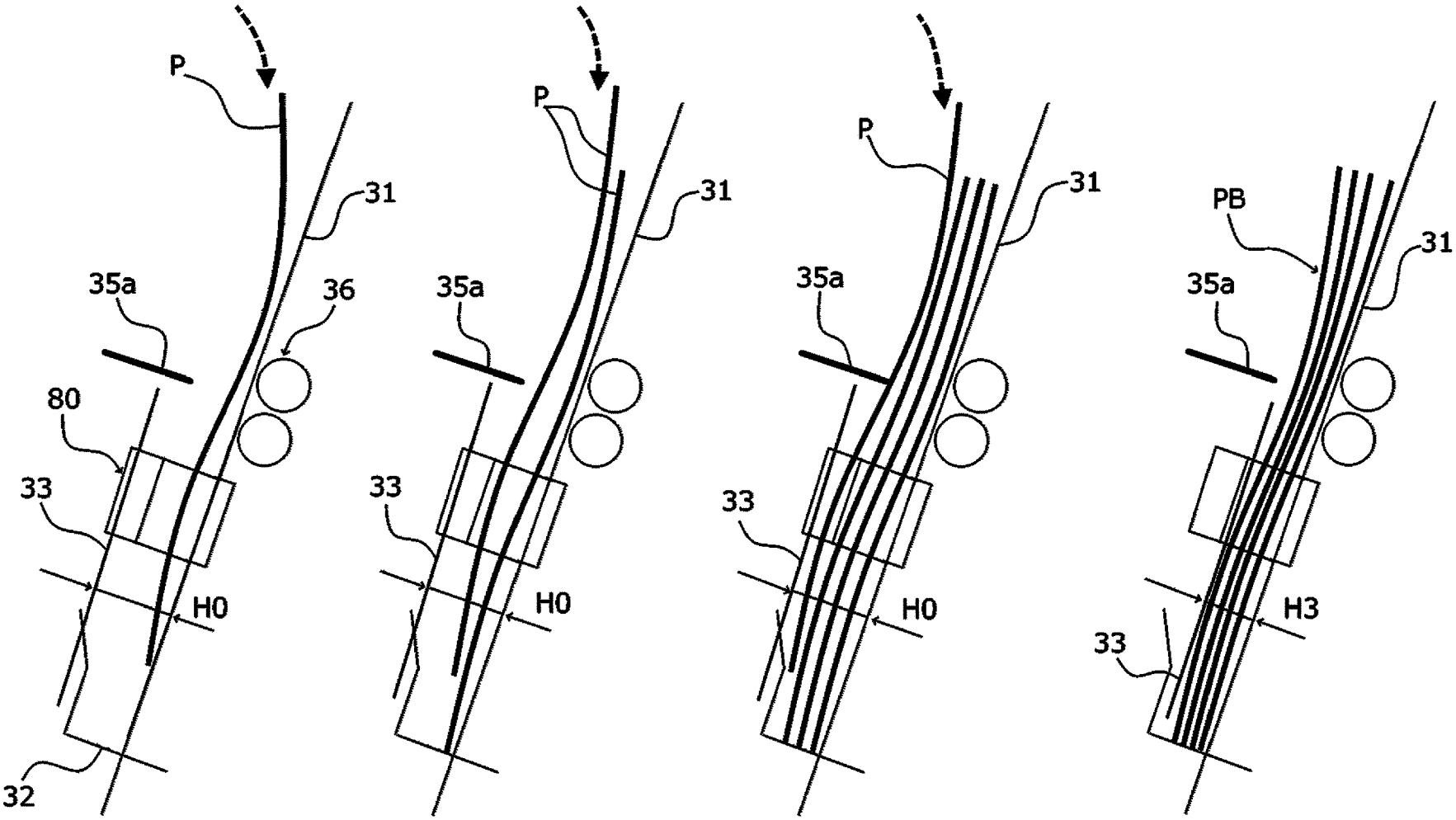
FIGS. 9A to 9D are schematic diagrams illustrating the flow of the middle-folding operation in the saddle-stitch-binding function unit according to the modification.

First, in the state where the guide 33 has been moved such that the gap H between the placement surface 31*a* of the compilation tray 31 and the guide 33 becomes maximum (S21), one of the sheets P on which an image has been formed by the image forming apparatus 1 is sent into the second sheet-transport path R2 through the receiving rollers 47 and transported along the second sheet-transport path R2 into the compilation tray 31 by the transport roller 39A (S22: see H0 in FIG. 9A).

Subsequently, it is determined whether the sheet P transported by the transport roller 39A is the last sheet (S23).

When it is determined in step S23 that the sheet P is not the last sheet (No in S23), the next sheet P is transported into the compilation tray 31 while the gap H between the placement surface 31*a* of the compilation tray 31 and the guide 33 is kept large (S22: see H0 in FIG. 9B). In this manner, the sheets P are transported into the compilation tray 31 in the state where the gap H between the placement surface 31*a* of the compilation tray 31 and the guide 33 is kept large until the last sheet is stacked on the compilation tray 31 (see FIG. 9C).

When it is determined that the sheet P transported to the compilation tray 31 is the last sheet (Yes in S23), the gap H between the placement surface 31*a* of the compilation tray 31 and the guide 33 is reduced (S24: see H3 in FIG. 9D), and a predetermined portion (e.g., the center portion) of the stack of sheets PB that has undergone sheet alignment is saddle stitched by the stapler 34 (S25).

Then, the saddle-stitched stack of sheets PB is moved in such a manner that the folded portion (e.g., the center portion) of the stack of sheets PB is located at the position of the tip of the folding knife 35*a* (S26), and the tip of the folding knife 35*a* comes into contact with the stack of sheets PB from the backside of the stack of sheets PB, so that the stack of sheets PB is pushed and lifted so as to be nipped between the folding rollers 36 (S27). After the folding rollers 36 have put a crease in the stack of sheets PB in the manner described above, the stack of sheets PB is transported as a booklet to the transport rollers 38 while the folded portion serves as the leading end of the stack of sheets PB and ejected onto the booklet tray TR3 (S28).

(2.4) Operation of Saddle-Stitch-Binding Function Unit

The saddle-stitch-binding function unit 30 of the post-processing apparatus 2 according to the present exemplary embodiment includes the guide 33 that faces the placement surface 31*a*, onto which the sheets P with images formed thereon by the image forming apparatus 1 are transported and stacked as the stack of sheets PB, so as to be capable of changing the gap H in the thickness direction of the stack of sheets PB and that guides the sheets P transported thereto and the sheet-processing controller 7 that controls the size of the gap H and a change pattern of the gap H. The sheet-processing controller 7 reduces the gap H to a predetermined size each time one of the sheets P is placed on the placement surface 31*a*. In other words, the operations of reducing and increasing the gap H is repeated each time one of the sheets P is placed on the placement surface 31*a* until the last sheet is stacked on the placement surface 31*a*.

In addition, first, the sheets P on which images have been formed by the image forming apparatus 1 are transported and stacked onto the compilation tray 31 in a state where the guide 33 has been moved such that the gap H between the placement surface 31*a* of the compilation tray 31 and the guide 33 becomes maximum until the last sheet P is stacked on the placement surface 31*a*. After that, the gap H between the placement surface 31*a* of the compilation tray 31 and the guide 33 is reduced, and the stack of sheets PB that has undergone sheet alignment is saddle stitched by the stapler 34.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing apparatus comprising:

a guiding unit that faces a placement surface onto which sheets are transported and stacked as a stack of sheets and that is capable of changing a gap in a thickness direction of the stack of sheets, the guiding unit being configured to guide the sheets which are transported; and a controller configured to:

control a size of the gap and a change pattern of the gap, reduce the gap to a predetermined size each time one of the sheets is placed on the placement surface, and gradually increase the predetermined size in accordance with the number of the sheets stacked on the placement surface.

2. The post-processing apparatus according to claim 1, wherein the controller reduces the gap to a predetermined size after the number of the sheets placed on the placement surface has reached two or larger.

3. The post-processing apparatus according to claim 1, wherein the controller changes the gap in accordance with a basis weight of each of the sheets and the number of the sheets stacked on the placement surface.

4. The post-processing apparatus according to claim 2, wherein the controller changes the gap in accordance with a basis weight of each of the sheets and the number of the sheets stacked on the placement surface.

5. The post-processing apparatus according to claim 3, wherein the predetermined size increases as the basis weight of each of the sheets becomes greater.

6. The post-processing apparatus according to claim 4, wherein the predetermined size increases as the basis weight of each of the sheets becomes greater.

7. The post-processing apparatus according to claim 3, wherein the predetermined size increases as the number of the sheets stacked on the placement surface becomes larger.

8. The post-processing apparatus according to claim 4, wherein the predetermined size increases as the number of the sheets stacked on the placement surface becomes larger.

9. The post-processing apparatus according to claim 1, wherein the gap is changed by the guiding unit moving with respect to the placement surface in a direction crossing a direction in which the sheets are transported.

10. The post-processing apparatus according to claim 1, wherein a folding operation is performed on the stack of sheets stacked on the placement surface in a state in which the gap has been reduced to a predetermined size.

* * * * *